US006979768B2

(12) United States Patent
Ito

(10) Patent No.: US 6,979,768 B2
(45) Date of Patent: Dec. 27, 2005

(54) ELECTRONIC MUSICAL INSTRUMENT CONNECTED TO COMPUTER KEYBOARD

(75) Inventor: Shinichi Ito, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/514,770

(22) Filed: Feb. 28, 2000

(65) Prior Publication Data

US 2003/0177891 A1 Sep. 25, 2003

(30) Foreign Application Priority Data

Mar. 2, 1999 (JP) ..... 11-054842

(51) Int. Cl.[7] ..... G10H 1/18
(52) U.S. Cl. ..... 84/615; 84/653
(58) Field of Search ..... 84/600–607, 615–620, 84/645, 477 R, 478

(56) References Cited

U.S. PATENT DOCUMENTS 4,662,261 A * 5/1987 Akutsu ..... 84/615
4,945,804 A * 8/1990 Farrand ..... 84/478 X
5,088,378 A * 2/1992 DeLaTorre ..... 84/470 R
5,286,908 A * 2/1994 Jungleib ..... 84/478 X
5,389,729 A * 2/1995 Hiramatsu ..... 84/601
5,565,641 A * 10/1996 Gruenbaum ..... 84/615
5,578,778 A * 11/1996 Imaizumi ..... 84/615
5,756,915 A * 5/1998 Matsuda ..... 84/602
5,861,567 A * 1/1999 Hirano ..... 84/615 X
5,990,404 A * 11/1999 Miyano ..... 84/615 X
6,063,994 A * 5/2000 Kew et al. ..... 84/600
6,078,004 A * 6/2000 Eitaki ..... 84/477 R
6,351,225 B1 * 2/2002 Moreno ..... 341/22

FOREIGN PATENT DOCUMENTS

JP 08-127576 5/1996
JP 10-307583 11/1998

OTHER PUBLICATIONS

Cakewalk Professional for Windows, Version 2.0 User's Guide. Twelve Tone Systems, Inc. 1992.*

* cited by examiner

*Primary Examiner*—Marlon T. Fletcher
*Assistant Examiner*—David S. Warren
(74) *Attorney, Agent, or Firm*—Morrison & Foerster LLP

(57) ABSTRACT

An electronic musical instrument is provided which enables various settings to be carried out quickly and easily. The electronic musical instrument is provided with at least one connection terminal for connection with a keyboard for use in a computer, and a connection interface for connecting the keyboard to the electronic musical instrument. Operation information input from the operation panel of the musical instrument is replaced by operation information input from the keyboard connected to the electronic musical instrument via the connection terminal and the connection interface.

3 Claims, 15 Drawing Sheets

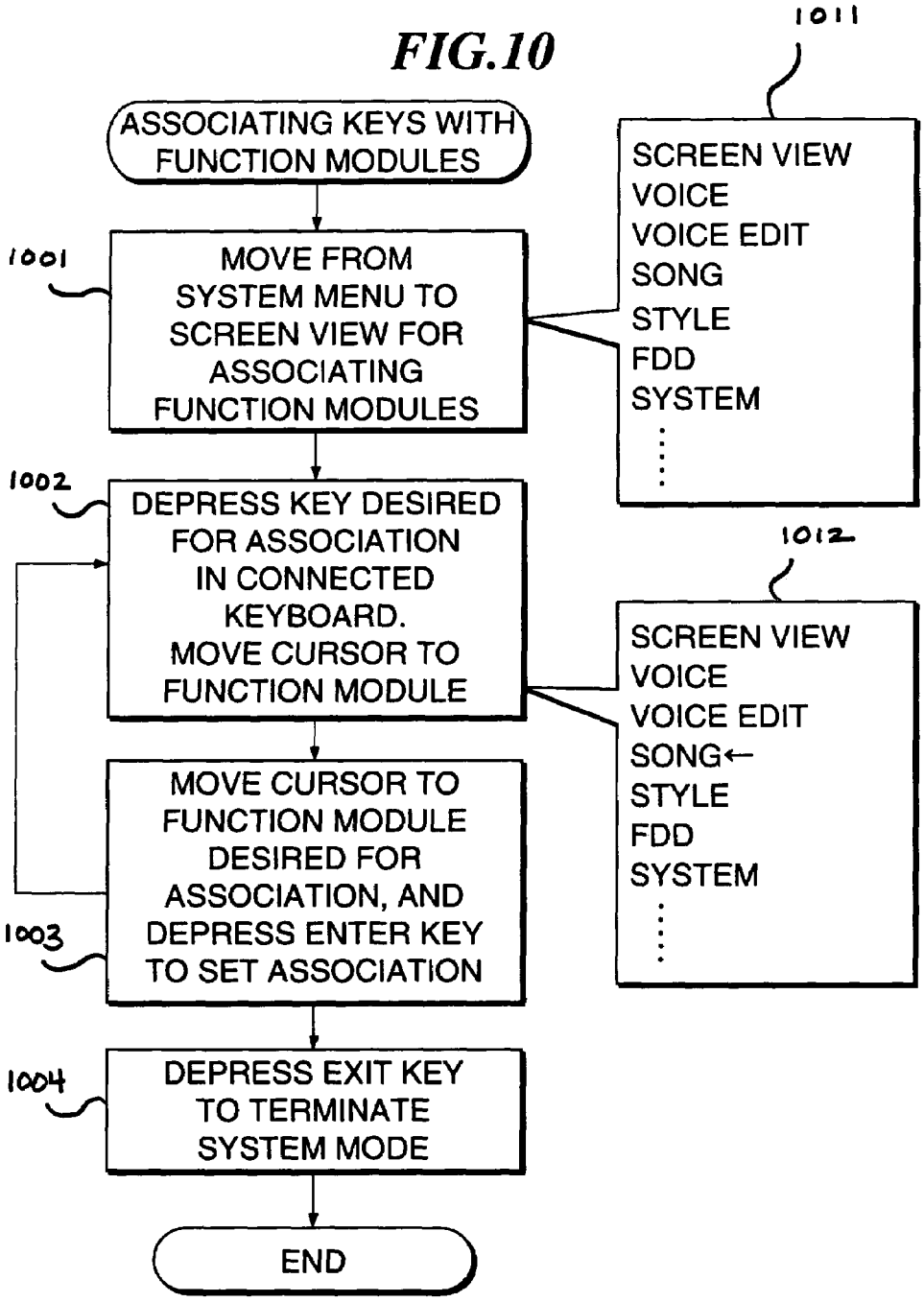
FIG.10
ASSOCIATING KEYS WITH FUNCTION MODULES
1001
MOVE FROM SYSTEM MENU TO SCREEN VIEW FOR ASSOCIATING FUNCTION MODULES
1002
DEPRESS KEY DESIRED FOR ASSOCIATION IN CONNECTED KEYBOARD. MOVE CURSOR TO FUNCTION MODULE
MOVE CURSOR TO FUNCTION MODULE DESIRED FOR ASSOCIATION, AND DEPRESS ENTER KEY TO SET ASSOCIATION
1003
1004
DEPRESS EXIT KEY TO TERMINATE SYSTEM MODE
END
1011
SCREEN VIEW
VOICE
VOICE EDIT
SONG
STYLE
FDD
SYSTEM
1012
SCREEN VIEW
VOICE
VOICE EDIT
SONG←
STYLE
FDD
SYSTEM

CONVERSION TABLE

MODULE TABLE

MACRO BUFFER

ELECTRONIC MUSICAL INSTRUMENT CONNECTED TO COMPUTER KEYBOARD

BACKGROUND OF THE INVENTION

1. Field of the Invention

The present invention relates to an electronic musical instrument, and more particularly to an electronic musical instrument which permits a keyboard as used in a personal computer to be connected to the instrument such that a user can operate the keyboard to carry out various settings for the electronic musical instrument.

2. Prior Art

Conventionally, an electronic musical instrument has several operating elements (operators) provided on its panel, and a user operates these operating elements to carry out various settings. A display device such as a LCD (Liquid Crystal Display) is also provided on the panel, and the user refers to various information on the display device to perform operations. There is also known another type of electronic musical instrument which is adapted to have a dedicated controller connected thereto, and, in addition to operations on the panel, the controller is used to carry out various settings for the electronic musical instrument.

In the conventional electronic musical instruments, however, in spite of a large number of parameters to be handled, the panel has a limited surface area so that only a limited number of switches can be arranged on the panel and only a display device having a small area for display can be provided. Thus, when the user wants to reach one function out of a wide variety of functions offered by the electronic musical instrument and carry out settings according to the function, a plurality of operations have to be done and a complicated procedure is required. For example, where a plurality of functions are assigned to one switch depending on the display screen view, the display screen view needs to be changed each time for the switch to be switched to the desired function. This is very troublesome. In the case where the dedicated controller is connected to the electronic musical instrument to carry out various settings for the electronic musical instrument, it is necessary to purchase the separate controller (proper to the instrument), and this is also troublesome.

SUMMARY OF THE INVENTION

It is an object of the present invention to provide an electronic musical instrument which has overcome the above mentioned problem and which enables various settings to be carried out quickly and easily.

To attain the above object, the present invention provides an electronic musical instrument comprising at least one connection terminal for connection with a keyboard for use in a computer, and a connection interface for connecting the keyboard to the electronic musical instrument.

To attain the above object, the present invention further provides an electronic musical instrument comprising an operation panel that is operated by a user, at least one connection terminal for connection with a keyboard for use in a computer, a connection interface for connecting the keyboard to the electronic musical instrument, and a replacing device that replaces operation information input from the operation panel by operation information input from the keyboard connected via the connection terminal and the connection interface.

In a preferred form of the present invention, the electronic musical instrument comprises an operation panel that is operated by a user, at least one connection terminal for connection with a keyboard for use in a computer, the keyboard having a plurality of keys, a connection interface for connecting the keyboard to the electronic musical instrument, an assigning device that assigns functions that can be executed by operating the operation panel respectively to the keys of the keyboard connected via the connection terminal and the connection interface, and an execution device that is responsive to operation of any of the keys of the keyboard, for executing one of the functions assigned to the operated key.

Preferably, the electronic musical instrument according to the present invention further comprises a display device, and a second assignment device that assigns characters, symbols, or numerical values respectively to the keys of the keyboard connected to the electronic musical instrument, and wherein when any of the keys of the keyboard are operated, the execution device causes the display device to display a character, a symbol, or a numerical value assigned to the operated key if the operation of the key is significant for a screen view currently displayed on the display, and execute one of the functions assigned to the operated key if the operation of the key is significant for the screen view currently displayed.

In another preferred form of the present invention, the electronic musical instrument comprises an operation panel that is operated by a user, at least one connection terminal for connection with a keyboard for use in a computer, the keyboard having a plurality of types of keys, a connection interface for connecting the keyboard to the electronic musical instrument, an assigning device that assigns functions that can be executed by operating the operation panel respectively to the types of keys of the keyboard connected via the connection terminal and the connection interface, and an execution device that is responsive to operation of any of the types of keys of the keyboard, for executing one of the functions assigned to the operated type of key.

Preferably, the electronic musical instrument according to the present invention further comprises a display device, and a second assignment device that assigns characters, symbols, or numerical values respectively to the types of keys of the keyboard connected to the electronic musical instrument, and wherein when any of the types of keys of the keyboard are operated, the execution device causes the display device to display a character, a symbol, or a numerical value assigned to the operated type of key if the operation of the type of key is significant for a screen view currently displayed on the display, and execute one of the functions assigned to the operated key if the operation of the type of key is significant for the screen view currently displayed.

The above and other objects and features of the present invention will become more apparent from the following detailed description taken in conjunction with the accompanying drawings.

BRIEF DESCRIPTION OF THE DRAWINGS

FIG. 10 is a flow chart showing a flow of a procedure for associating keys with function modules;

DETAILED DESCRIPTION OF THE PREFERRED EMBODIMENT

The present invention will now be described in detail with reference to the drawings showing an embodiment thereof.

Figure 1:
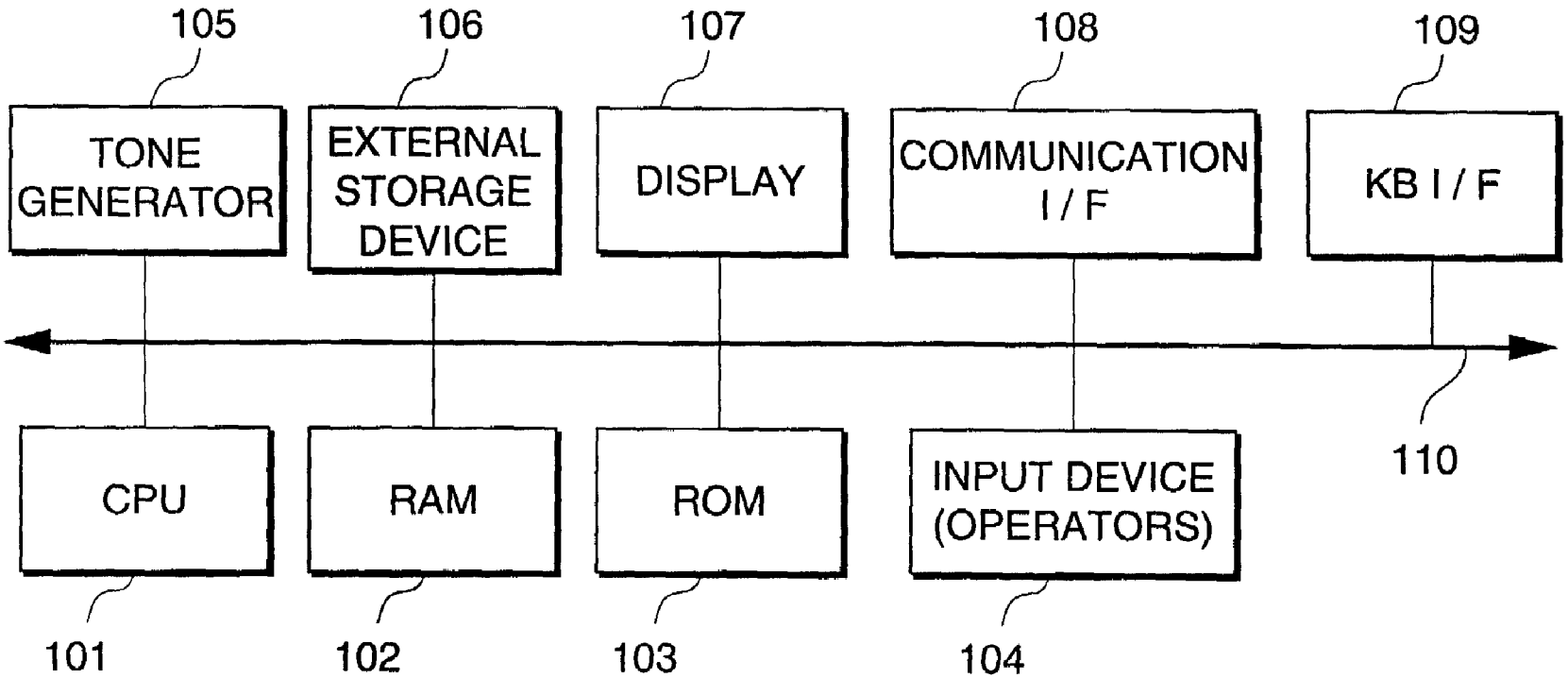
FIG. 1 is a block diagram showing the construction of an electronic musical instrument according to an embodiment of the present invention.

FIG. 1 is a block diagram showing the construction of an electronic musical instrument according to an embodiment of the present invention. The electronic musical instrument according to the present embodiment is comprised of a central processing unit (CPU) 101, a random access memory (RAM) 102, a read only memory (ROM) 103, an input device 104, a tone generator 105, an external storage device 106, a display 107, a communication interface (I/F) 108, a keyboard interface (KB I/F) 109, and a bus line 110.

The CPU 101 controls the overall operation of the electronic musical instrument, and in particular, controls processing of operation information entered from a keyboard for a personal computer (hereinafter referred to simply as "the PC keyboard") which is connected to the electronic musical instrument as described later. The RAM 102 is a volatile memory used as a work area or the like that is necessary for the operation of the CPU 101. The ROM 103 is a non-volatile memory storing programs and data which are executed and utilized by the CPU 101. The input device 104 includes various operating elements (including a keyboard operated by the user in musical performance) provided on a panel and other parts of the electronic musical instrument. The tone generator 105 generates musical tones based on instructions from the CPU 101. The external storage device 106 is comprised of a storage medium such as a floppy disk or a memory card for storing various setting data and musical tone data. The display 107 is comprised of a display device provided on the panel of the electronic musical instrument. The communication I/F 108 is comprised of a MIDI interface which is connected to other electronic musical instruments, and an interface for connection to a personal computer (PC). The KB I/F 109 is an interface for connection to the PC keyboard. These parts are connected to each other via the two-way bus line 110.

Figure 2:
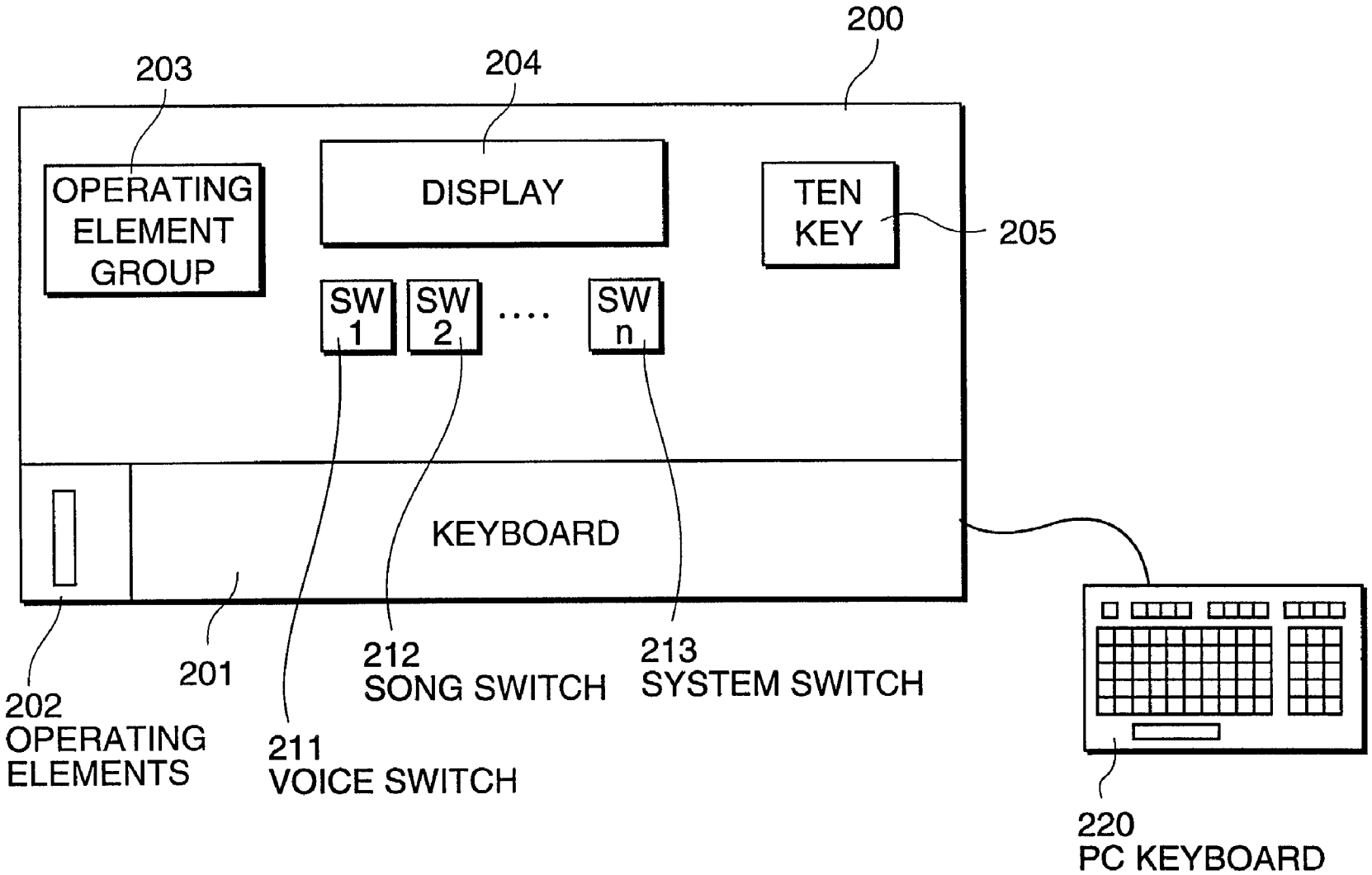
FIG. 2 is a view showing the exterior appearance of a panel of the electronic musical instrument of FIG. 1.

FIG. 2 shows the exterior appearance of the panel of the electronic musical instrument. There are disposed on the panel a keyboard 201, a performance operating element 202, an operating element group 203, a display 204, a ten-key pad 205, a voice (VOICE) switch 211, a song (SONG) switch 212, and a system (SYSTEM) switch 213. Besides these parts, the electronic musical instrument of the present embodiment is constructed such that a PC keyboard 220 can be connected to the instrument and the user is able to carry out various settings for the electronic musical instrument by operating the PC keyboard 220. This will be described in detail later.

The keyboard 201 has a plurality of keys for the user to operate in musical performance. The performance operating element 202 is comprised of operating elements operated for performance by the user in addition to the keyboard. The operating element group 203 is comprised of operating elements for the user to carry out various settings. The display 204 is used to indicate various information. The ten-key pad 205 is comprised of numeric keys of 0 to 9 for entering numerical data, and an enter (ENTER) key. The voice switch 211 is turned on to execute a selecting function of selecting tone colors (voice) of musical tones generated by the electronic musical instrument. The song switch 212 is turned on to execute a selecting function of selecting data for use in automatic accompaniment or automatic performance (song data) by the electronic musical instrument. The system switch 213 is turned on to execute a function of setting a system option to be performed by the electronic musical instrument.

The keyboard 201, operating element 202, operating element group 203, ten-key pad 205, and switches 211 to 213 constitute operating elements included in the input device 104 of FIG. 1. The display 204 corresponds to the display 107 of FIG. 1. The PC keyboard 220 is connected to the electronic musical instrument via the KB I/F 109 of FIG. 1.

Figure 3:
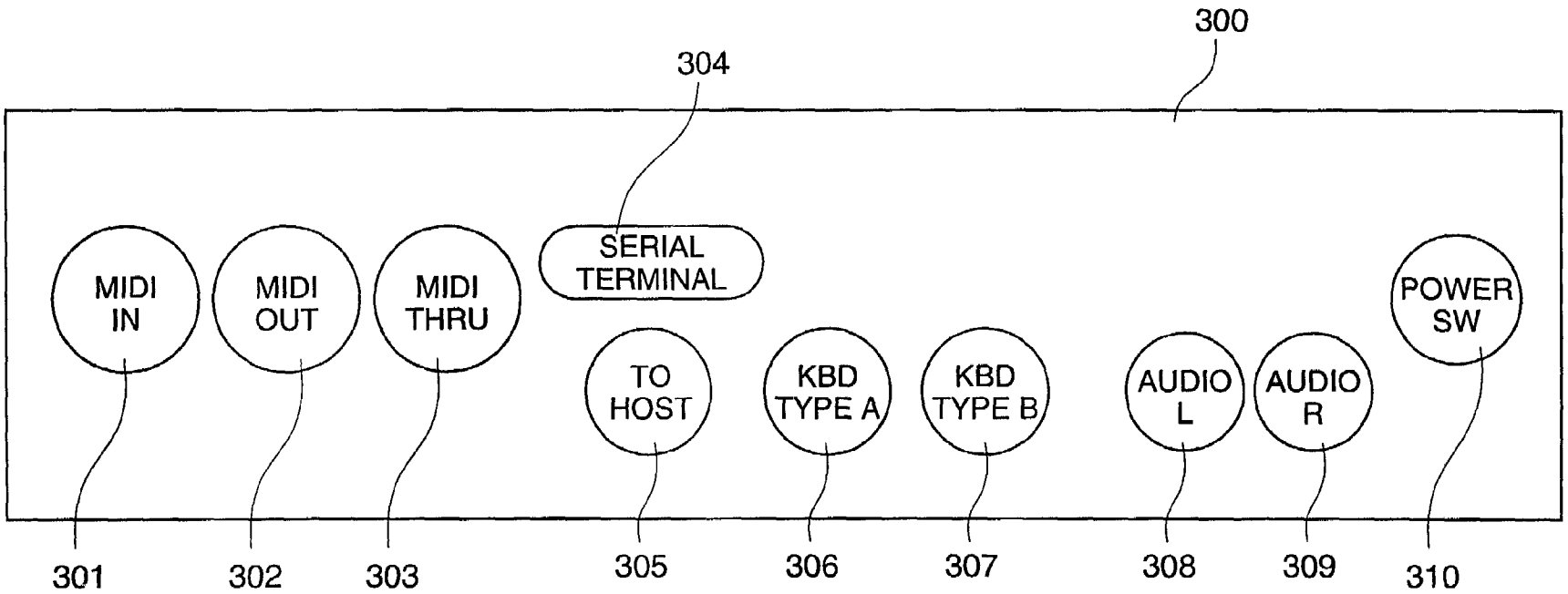
FIG. 3 is a view showing the exterior appearance of a back face of the electronic musical instrument.

FIG. 3 shows the exterior appearance of a back face of the electronic musical instrument. On the back face 300, there are provided a MIDI input terminal 301, a MIDI output terminal 302, a MIDI through terminal 303, a serial terminal 304, a host connection terminal 305, a type-A keyboard connection terminal 306, a type-B keyboard connection terminal 307, left and right audio signal output terminals 308, 309, and a power switch 310. The MIDI terminals 301 to 303 are used for connection with external MIDI equipment according to the MIDI standard. The serial terminal 304 is a serial interface such as RS-232C. The host connection terminal 305 is used for connection with an external host computer. The keyboard connection terminals 306, 307 are used for connection with PC keyboards so that various settings for the electronic musical instrument can be performed from the PC keyboards. Since there are several types of PC keyboards corresponding to the types of PCs (for example, for DOS/V machine, for MAC, for UNIX), keyboard connection terminals corresponding to these PC keyboards are provided in the present embodiment.

Figure 4:
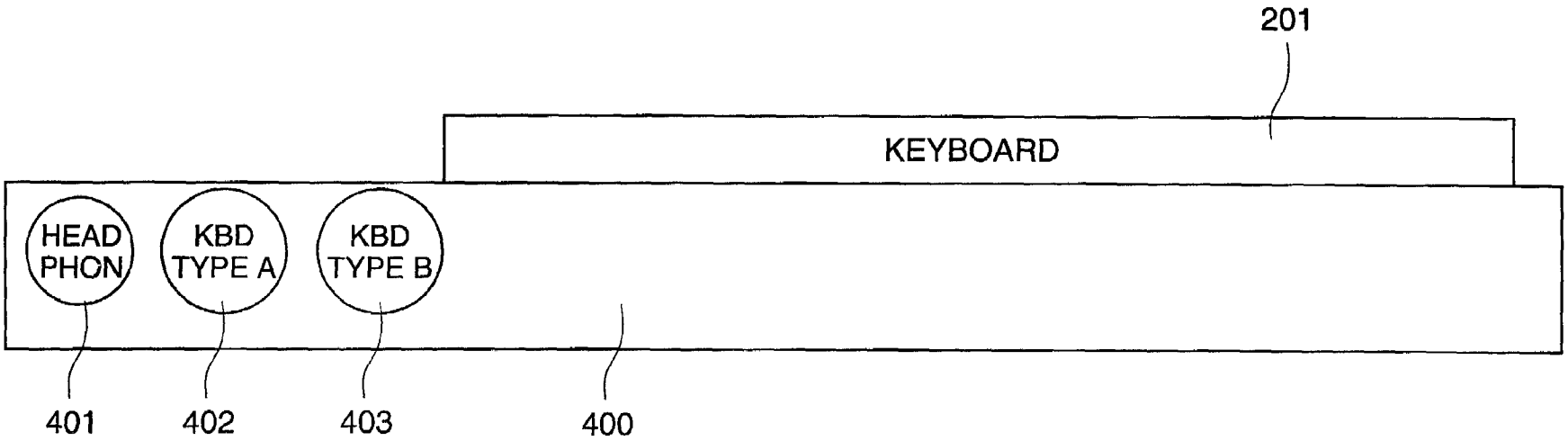
FIG. 4 is a view showing the exterior appearance of a front face of the electronic musical instrument.

A plurality of connection terminals for accommodating keyboards for a plurality of types of PCs may be provided only in a higher grade model of the electronic musical instrument, and only a connection terminal for accommodating only a keyboard for a widely used PC keyboard such as one for the DOS/V machine may be provided in a lower grade model. Connection terminals for PC keyboards may be provided on the front face of the electronic musical instrument as shown as terminals 402, 403 in FIG. 4, instead of being provided on the back face of the electronic musical instrument as shown in FIG. 3. Where the electronic musical instrument is usually housed in a rack such as a tone generator box, the back face portion is concealed at the back side of the rack so that, if a connection terminal for the PC keyboard is provided on the back face, the user may find it difficult to connect the PC keyboard. Therefore, it is preferable to provide connection terminal(s) for PC keyboard(s) on the front face as shown in FIG. 4. Connection terminals for the PC keyboard may be provided on both the back face and the front face.

Figure 5:
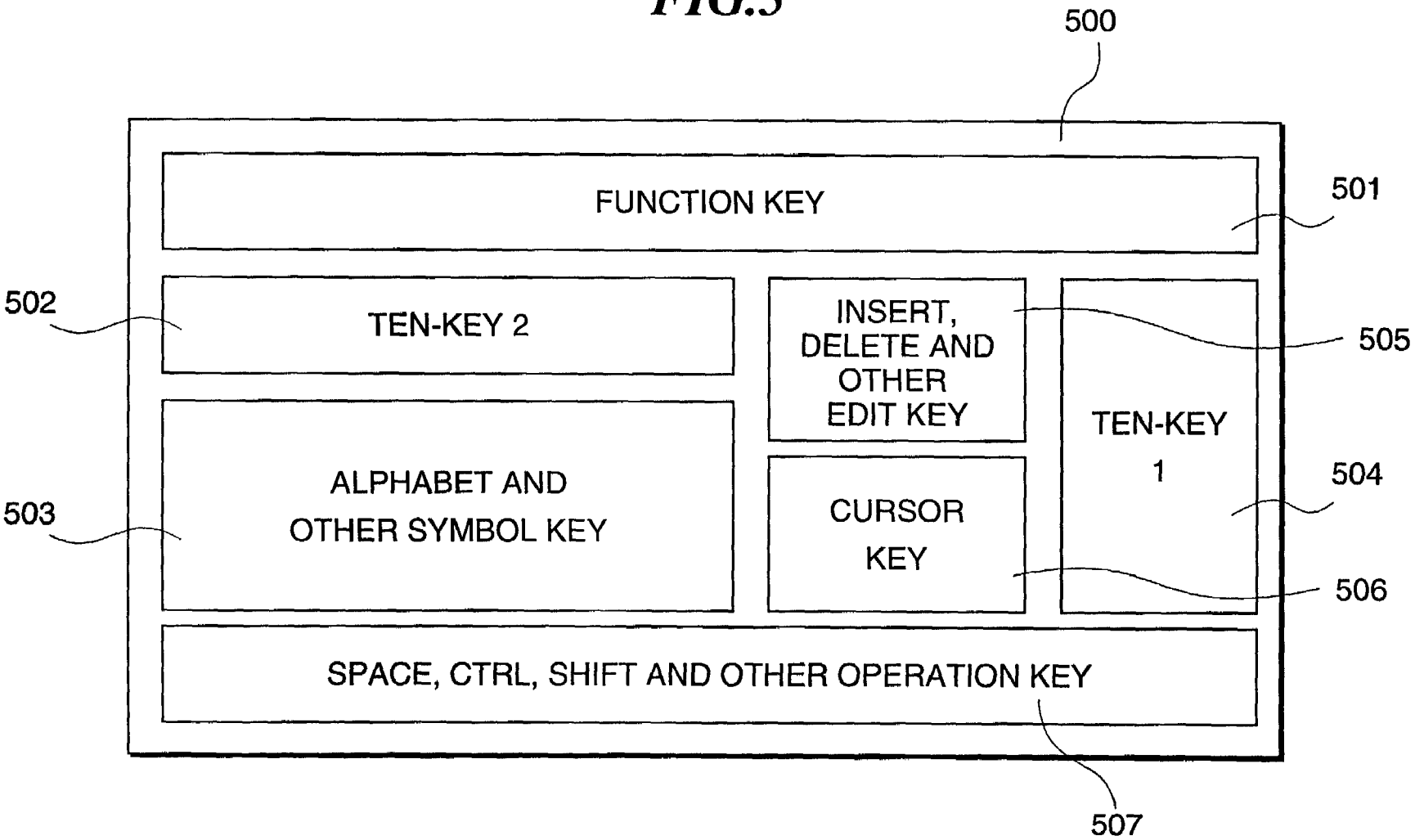
FIG. 5 is a view showing an example of a PC keyboard that can be connected to the electronic musical instrument.

FIG. 5 shows an example of the PC keyboard that is connected to the electronic musical instrument of the present embodiment. This PC keyboard 500 is comprised of a function key 501, ten key pad 502 (hereinafter referred to as "ten-key 2"), alphabet and other symbol keys 503, ten key pad 504 (hereinafter referred to as "ten-key 1"), edit key 505, cursor key 506, and operation key 507. In FIG. 5, a plurality of keys of the same kind are grouped and shown in a block. For example, the function key 501 is comprised of a plurality of function keys. The ten-key 2 is comprised of numeric keys arranged on the upper side of the alphabet and other symbol keys. The edit key 505 is comprised of an insert key, a delete key, and so forth. The cursor key 506 is comprised of keys that instruct a cursor on a display screen to move up and down as well as right and left. The operation key 507 is comprised of a space key, a control (CTRL) key, a shift (SHIFT) key, and so forth. The PC keyboard as shown in FIG. 5 is connected to one or more of the keyboard connection terminals 306, 307 in FIG. 3 or the connection terminals 402, 403 in FIG. 4, which are of the same type as the PC keyboard.

There are a plurality of kinds of key arrangement on the PC keyboard. The key arrangement varies with the kind of machine (computer) or in accordance with the national standards. Therefore, the electronic musical instrument is designed such that certain key arrangements of the PC keyboard that are popular to some extent can be designated by selecting a template from a system menu of the electronic musical instrument.

Figure 6:
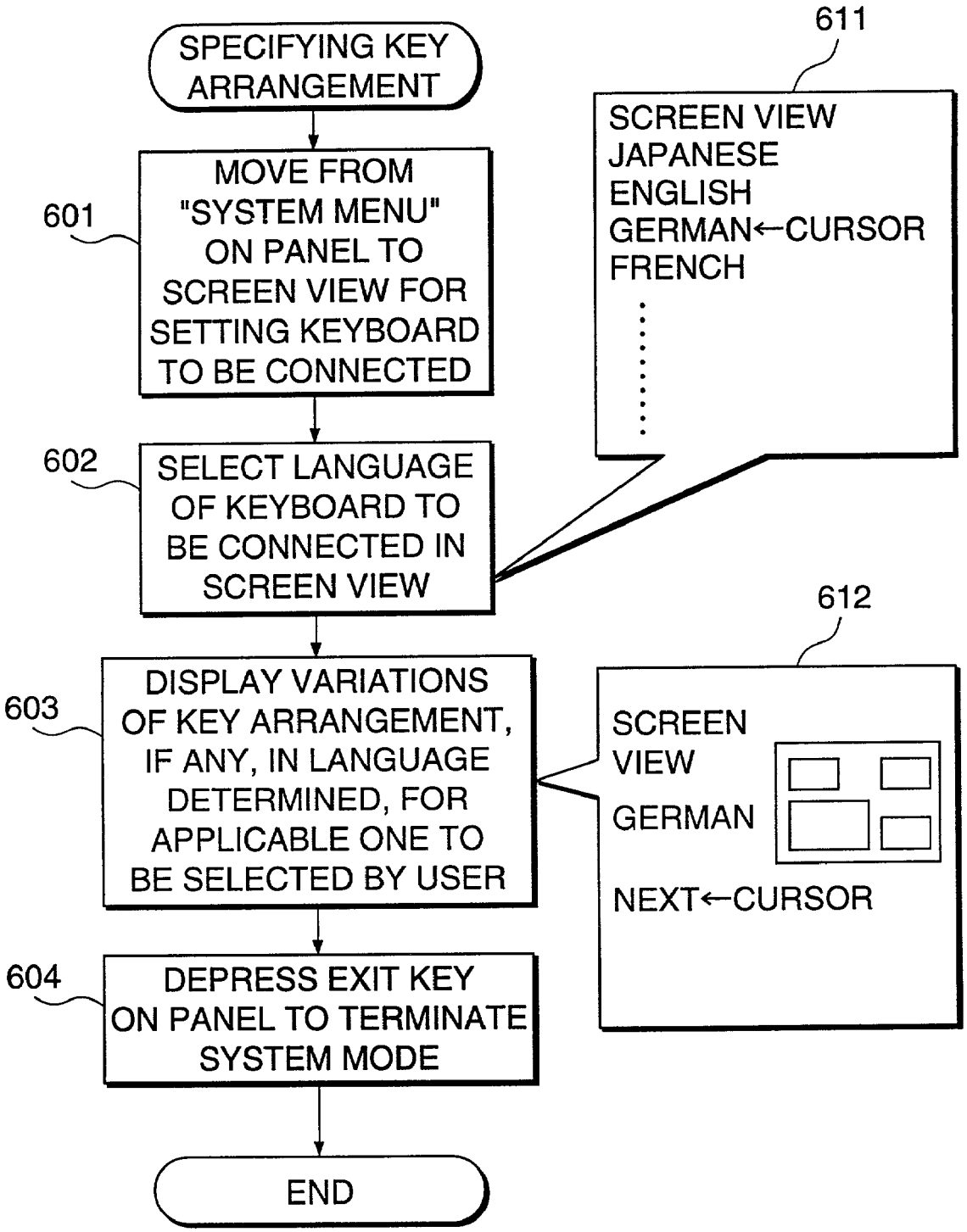
FIG. 6 is a flow chart showing a flow of a procedure for specifying a key arrangement.

FIG. 6 shows a flow of a procedure for specifying one of a plurality of key arrangements according to language (standard) or kind of machine. When the system switch 213 in FIG. 2 is turned on, a system menu is displayed on the display 204 and the procedure of FIG. 6 starts. First, in step 601, a function of specifying the key arrangement of the PC keyboard is selected from the system menu, and the screen view of the display 204 is changed to a view for setting the PC keyboard. The view for setting the PC keyboard is in the form of a list of languages representing key arrangements of the PC keyboard. If another function is selected from the system menu, the operation moves to processing for performing the selected function.

Next, in step 602, one language is selected from the list of languages of the PC keyboard displayed on the display 204. Screen view 611 shows how selection of the language of PC keyboard to be connected is carried out. Several alternatives such as "JAPANESE", "ENGLISH", "GERMAN", and "FRENCH" are displayed on the screen, and the cursor is set to one of the languages that is currently selected. To select the language of the keyboard to be connected, the user sets the cursor to the language to be selected. In step 603, if there are variations of key arrangement of the PC keyboard in the selected language, these variations are displayed on the screen and an applicable key arrangement is selected. Screen view 612 shows an example of the screen view that is displayed in the step 603 when the language "GERMAN" is selected in the step 602. An example of the key arrangement in the language "GERMAN" is displayed together with a character string "next" from which the operation is to proceed to display of the next alternative. If the key arrangement displayed in the screen view 612 is to be selected, the user selects the displayed keyboard arrangement. Otherwise, the character string "next" is clicked for the operation to proceed to display of the next alternative. After execution of the step 603, an exit (EXIT) key on the panel is turned on in step 604 so that the operation goes through the present system mode to terminate the procedure.

The operations in the steps 601 to 603 by the user may be performed by operating predetermined keys of the operating element group 203 on the panel, or alternatively, if the operations can be performed using the PC keyboard that is connected at that time, the PC keyboard may be used for the operations.

Figure 7:
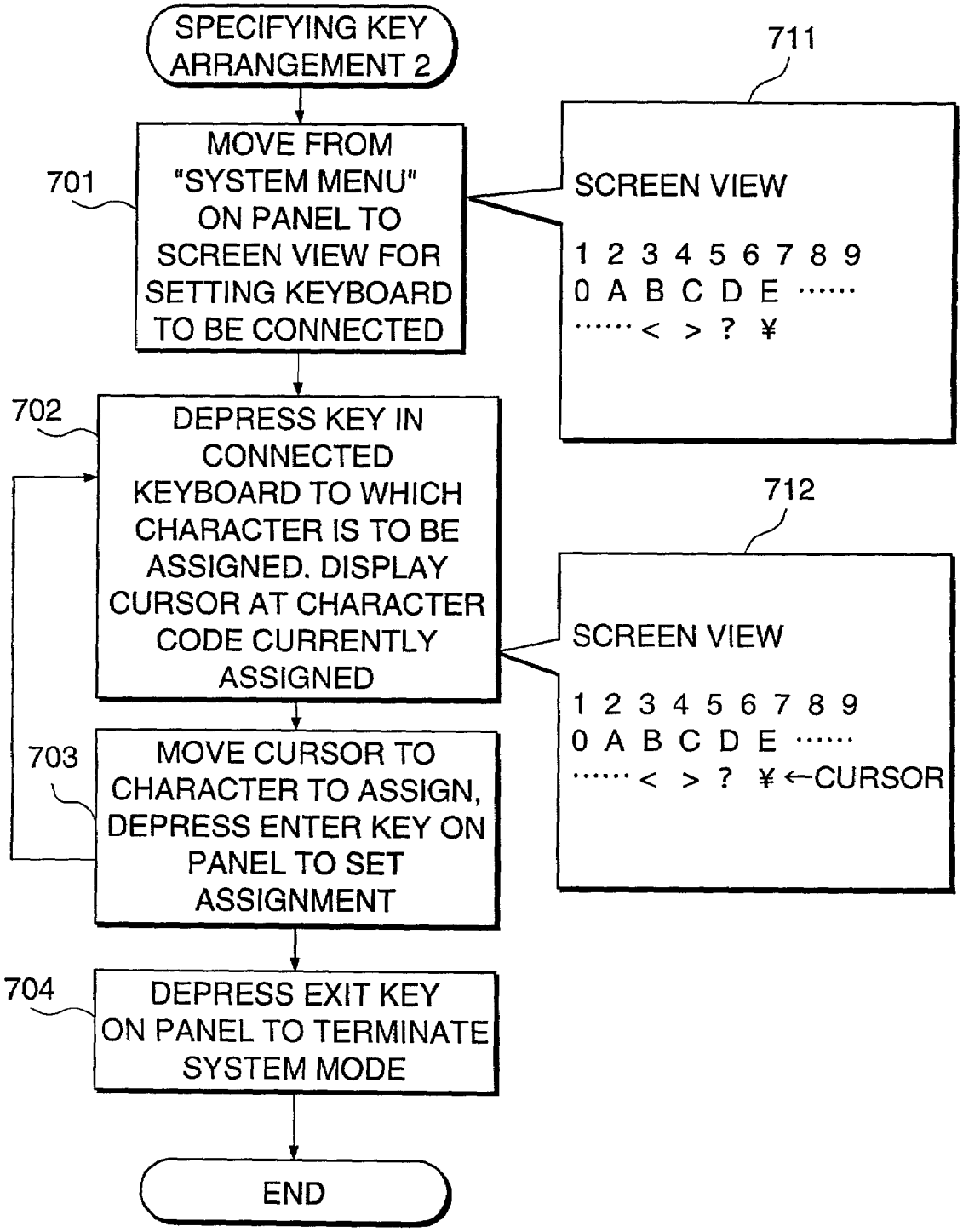
FIG. 7 is a flow chart showing a flow of another procedure for specifying a key arrangement.

FIG. 7 shows an example of the procedure for specifying the key arrangement of PC keyboard to be connected. This procedure may be used instead of the procedure of FIG. 6. When the system switch 213 in FIG. 2 is turned on, a system menu is displayed on the display 204, and the procedure of FIG. 7 starts. First, in step 701, the function of specifying the key arrangement of PC keyboard is selected from the system menu displayed on the display 204, and the screen view of the display 204 is changed to a view for setting the PC keyboard. The view for setting the PC keyboard is in the form of a list of characters that can be entered. If another function is selected from the system menu, the operation moves to processing for performing the selected function.

Next, in step 702, a key on the connected PC keyboard to which the user wishes to assign a character is depressed. This causes the cursor to be displayed at a character which is currently assigned to the depressed key by a character code. Screen view 712 shows that a key on the PC keyboard has been depressed so that the cursor is displayed at a position of a sign "¥". Then, in step 703, the cursor is moved to a character which the user wishes to assign to the key, and an enter key on the panel is depressed to set the assignment. If the user wishes to change an assignment to another key on the PC keyboard, the steps 702 and 703 are repeatedly executed to set the correspondence between the key and a character code. When all the settings are completed as the user desires, the exit key on the panel is turned on in step 704, and the operation goes through the system mode to terminate the procedure.

By the selection of the key arrangement of FIG. 6 as described above, it is possible to readily select the desired key arrangement in the form of a template from the system menu according to the language, standard or machine type. By the selection of characters as shown in FIG. 7, it is possible to make assignment to individual keys one by one. The operations of specifying the key arrangement shown in FIGS. 6 and 7 may be combined. For example, after a general key arrangement is selected and set by the procedure of FIG. 6, the setting may be modified in part according to the user's desire by the procedure of FIG. 7. It is also possible to assign the same character to a plurality of keys in accordance with the procedure of FIG. 7. This enables, for example, ten key pads to be provided in a plurality of regions. A code that is sent to the main body of the electronic musical instrument when a key of the PC keyboard is depressed is a position code of the depressed key. When a key arrangement is determined in accordance with the procedures of FIG. 6 and FIG. 7, a character or an ASCII code corresponding to the position code of each key is determined. The correspondence between the position code of each key and the ASCII code for the key is stored as a conversion table of FIG. 15A in the RAM.

Once the PC keyboard is thus connected to the electronic musical instrument and the electronic musical instrument is made to recognize the key arrangement, various settings for the electronic musical instrument can be performed by operating the PC keyboard. The correspondence between keys of the PC keyboard and function modules to be started respectively when the keys are depressed is determined in advance as a default. As described later, it is also possible for the user to set arbitrarily the correspondence between the keys and the function modules to be started.

The PC keyboard shown in FIG. 5 is provided with the ten-key 1 disposed at a right side of the keyboard, and the ten-key 2 disposed at an upper side of the alphabet key. In such a case where there are a plurality of ten key pads, the respective roles of the ten key pads are determined in advance as a default. For example, "when the ten-key 1 is operated, switch the display screen view to the voice (tone color) selection screen view, and change the voice in accordance with the input value", or "when the ten-key 2 is operated, switch the display screen view to the song selection screen view, and change the song in accordance with the input value", and so forth. In this way, operations in the conventional electronic musical instrument, such as, for example, "depress the voice switch, switch the screen view to a voice mode, and designate a tone color number with a ten key", or "depress the song switch, switch the screen view to a song mode, and designate a song number with a ten key" can be replaced by operations from the PC keyboard using only the ten keys.

Figure 8:
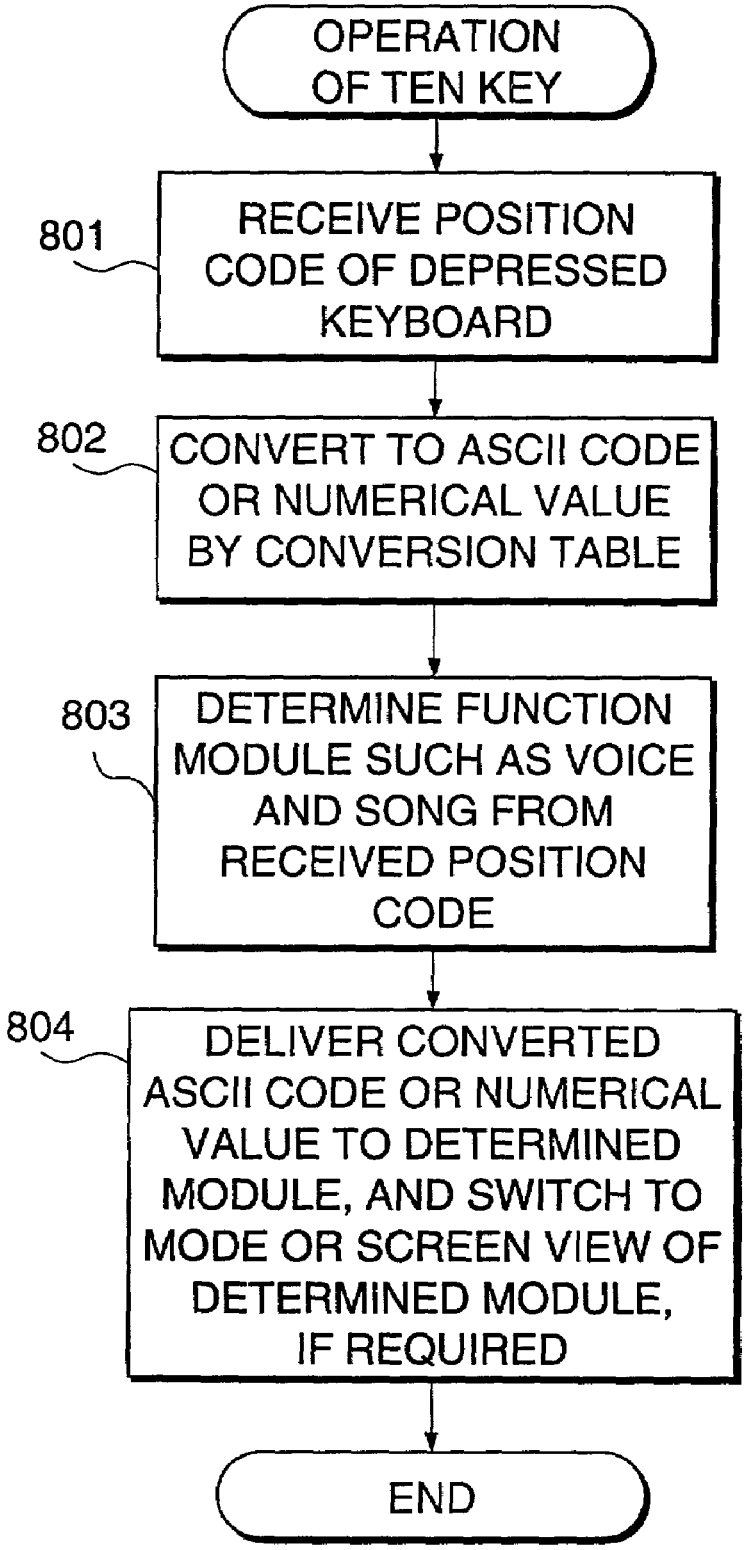
FIG. 8 is a flow chart showing a flow of a processing operation executed when a ten-key is operated.
Figure 15A:
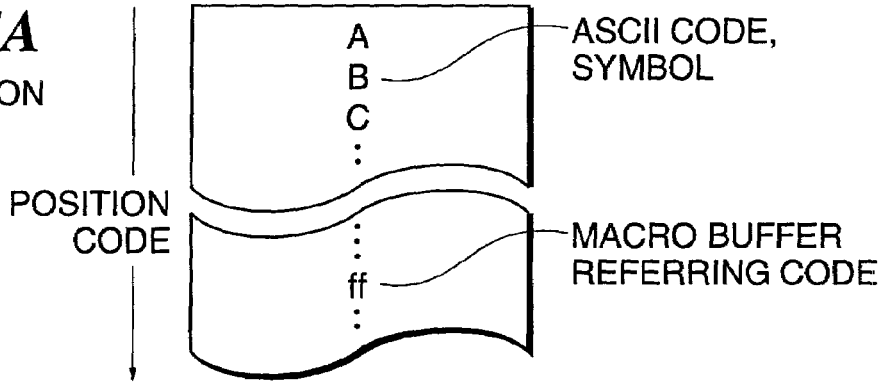
FIG. 15 is a view showing the formats of various tables.

FIG. 8 shows a flow of a processing operation executed when a ten key of the PC keyboard is operated. In step 801, a position code of the depressed ten key is received. As described above, the PC keyboard has sometimes ten keys provided at a plurality of locations, and each depressed key outputs a position code corresponding to the position where the key is located. Therefore, even if the same numeric key "1" is depressed, it can be determined from the position code whether the key depressed is a numeric key in the ten-key 1 in FIG. 5 or a numeric key in the ten-key 2 in the figure. In step 802, by referring to the conversion table, the received position code of the key is converted to an ASCII code or numerical data. FIG. 15A shows the format of the conversion table. The conversion table allows the ASCII code (alphabet letter, symbol, number and the like) corresponding to the key to be found by referring to the position code of the key as the relative address.

Figure 15B:
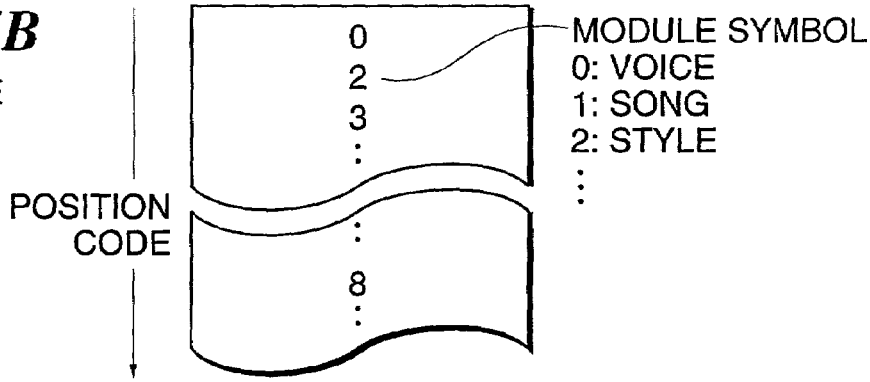

Next, in step 803, a function module that is to be started in accordance with depression of the key is determined from the received position code of the key. The correspondence between key positions and function modules to be executed when the respective keys are depressed is defined by a module table. FIG 15B shows the format of the module table. The module table allows a function module number corresponding to the key to be identified by referring to the position code of the key as the relative address. The module number is used to discriminate each function module. For example, a module number 0 denotes a function module VOICE for performing a voice selection operation, a module number 2 denotes a function module SONG for performing a song selection operation, and so forth. The step 803 thus discriminates the function module corresponding to the received position code with reference to the module table.

Then, in step 804, the ASCII code or the numerical data obtained in the step 802 is delivered to the function module that is discriminated as described above, and if required, the operation is switched to the mode or screen view of the function module, followed by terminating the processing operation. Thereafter, the function module is executed.

Figure 9:
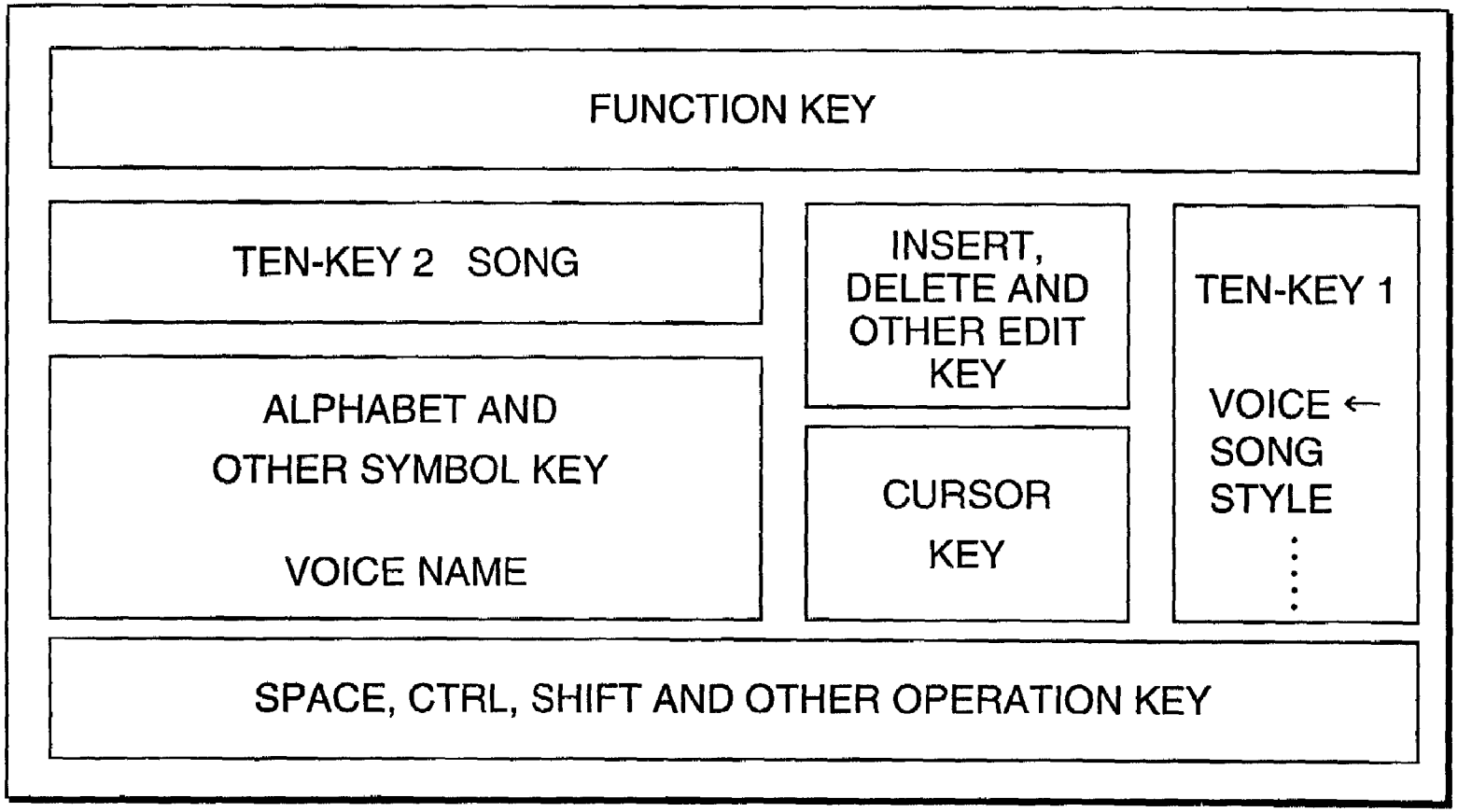
FIG. 9 is a view showing an example of screen view for associating key regions with function modules.

The correspondence between position codes of keys and respective corresponding function modules (that is, the contents of the module table of FIG. 15B) is set in advance as a default. However, the user may modify the setting of the correspondence, as desired. FIG. 9 shows an example of the screen view for setting the correspondence between types of keys and function modules to be executed respectively when the types of keys are depressed. After the system switch 213 of FIG. 2 is turned on to display the system menu, the operation moves to a function assignment screen view. Then, for each key arrangement set as described with reference to FIG. 6 and FIG. 7, a screen view as shown in FIG. 9 is displayed. This screen view is used with the cursor to establish the correspondence between key regions and function modules.

For example, on the screen view of FIG. 9, the region of the ten-keys 2 is indicated as "SONG", and the region of the alphabet and other symbol keys is indicated as "VOICE NAME". This shows that the keys in the region of the ten-key 2 are associated with a song selection function module, and the alphabet and other symbol keys are associated with a voice name selection function module. In the FIG. 9 screen view, when the cursor is moved to each key region, function module candidates with which that key region can be associated are displayed, and the cursor is positioned at the function module with which the key region is currently associated. The illustrated example of FIG. 9 shows that the cursor has been moved to the region of ten-key 1, so that the cursor is set at the function module "VOICE" with which the ten-key 1 is currently associated. Other candidates such as "SONG" and "STYLE" are also displayed. From this state, the cursor can be moved by the cursor key to change the function module to be associated.

In the screen view of FIG. 9, the association with the function modules is made for types of key. It is also possible to assign function modules to individual keys. In this case, in FIG. 9, all keys are individually displayed and similar operations as described above are performed.

The assignment may also be made by a procedure as shown in FIG. 10. In FIG. 10, in step 1001, the operation moves from the system menu to the screen view for establishing the correspondence between keys and function modules. Then, as shown in a screen view 1011, a list of function modules that can be assigned is displayed. Next, in step 1002, a key in the connected PC keyboard to which the user wishes to assign a function module is depressed. On the screen view, this results in the cursor being set to a function module which is currently assigned to the depressed key. Screen view 1012 shows the cursor being set to "SONG". Then, in step 1003, the cursor is moved to a function module which the user wishes to assign to the key, and the enter key is depressed to set the assignment. This determines the function module to be assigned to the key that has been depressed in the step 1002. The steps 1002 and 1003 are repeated as required, to assign function modules to keys. In step 1004, the exit key is depressed to go through the system mode and terminate the operation.

The correspondence between the position codes of keys and function modules which has been established in this manner is stored in the RAM as the module table of FIG. 15B.

Figure 11:
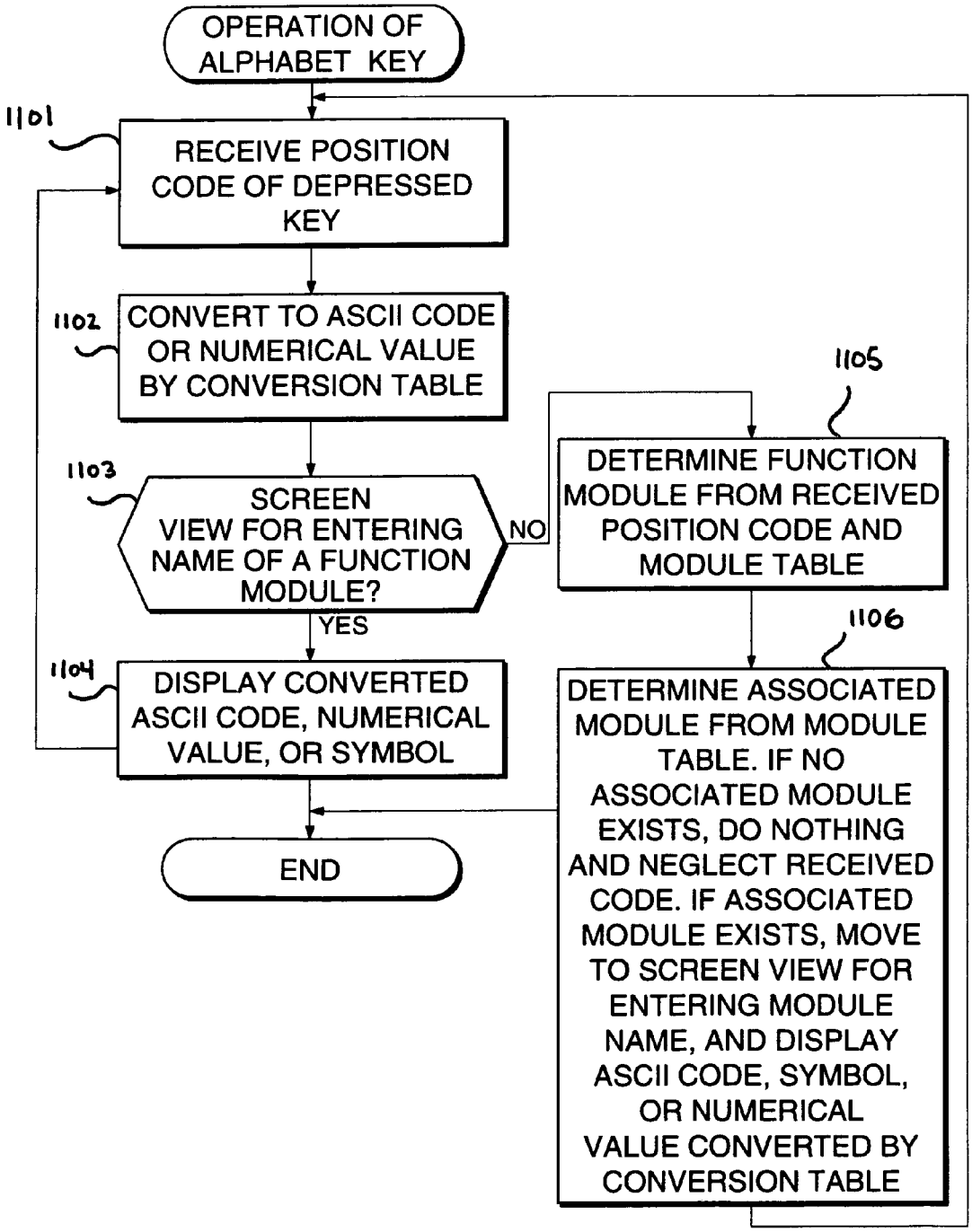
FIG. 11 is a flow chart showing a flow of a processing operation executed when an alphabet key is operated.

FIG. 11 is a flow chart showing a flow of processing operation executed when an alphabet key is operated if a function module is assigned to the alphabet key. First, in step 1101, the position code of the depressed key is received. Then, in step 1102, by referring to the conversion table (FIG. 15A), an ASCII code (or numerical data) corresponding to the position code is obtained. Next, in step 1103, it is determined whether the current screen view is a name entering view of any function module (more specifically, whether the current screen view is focused on a name entering screen view and the cursor is set to a name entering region thereof) or not. If it is determined that the current screen view is a name entering screen view of some function module, in step 1104, the above converted ASCII code is displayed in the name entering region, and the operation returns to step 1101. If in step 1103, it is determined that the current screen view is not a name entering screen view, in step 1105, by referring to the module table of FIG. 15B, a function module corresponding to the received position code is discriminated. Next, in step 1106, if there is no corresponding function module, the received code is neglected and the operation is immediately terminated. If there is a corresponding function module, the operation moves to the name entering screen view of the function module, and the ASCII code obtained from the conversion table is displayed, and then the operation is terminated.

Thus, according to the processing operation described above, even when a key corresponding to a function module is depressed, if the current screen view is the name entering screen view of some function module, the key entry is recognized simply as entry of an ASCII code. On the other hand, if the current screen view is not a name entering screen view, a function module corresponding to the depressed key is started, to display the depressed key in the name entering screen view of the function module. In an electronic musical instrument, in naming a tone color, a song or a file, alphabet or other symbol keys may be used for entry of the names. In some conventional electronic musical instruments, alphabet letters are allocated to keys of the ten-key pad on the panel and the alphabet letters are input by operating keys of the ten-key pad a plurality of times. According to the present embodiment, such a complicated operation can be replaced by a very simple operation.

The above described processing operation of FIG. 11 refers to the operation of alphabet keys. This may be applied to other keys. That is, if the entry of a key is significant for the current screen view, the entered character is displayed as it is, and otherwise a function module corresponding to the entered key is started to deliver the entered key to the function module.

Further, whether a function module assigned to the entered key is to be started or not may be designated by a defined operation by the user. For example, the depression of the CTRL key followed by depression of an alphabet key may force a function module assigned to the alphabet key to be started to deliver the entered key to the function module.

In the electronic musical instrument according to the present embodiment, a plurality of operations can be assigned to one key. The assigned key will be referred to as a short-cut. There are two methods of this assignment. One is to display all functions in the system menu, and enter and set a short-cut corresponding to each function from the PC keyboard. The other method is to perform a plurality of operations to call a certain function screen view with operating elements on the panel, and perform a predetermined operation from the PC keyboard (for example, turning-on of a CTRL key to be assigned as a short-cut+a key to be memorized as a short-cut) when the screen view comes to the certain function screen view. The keys to be assigned as short-cuts may be limited to a part of the keys such as function keys.

Figure 12:
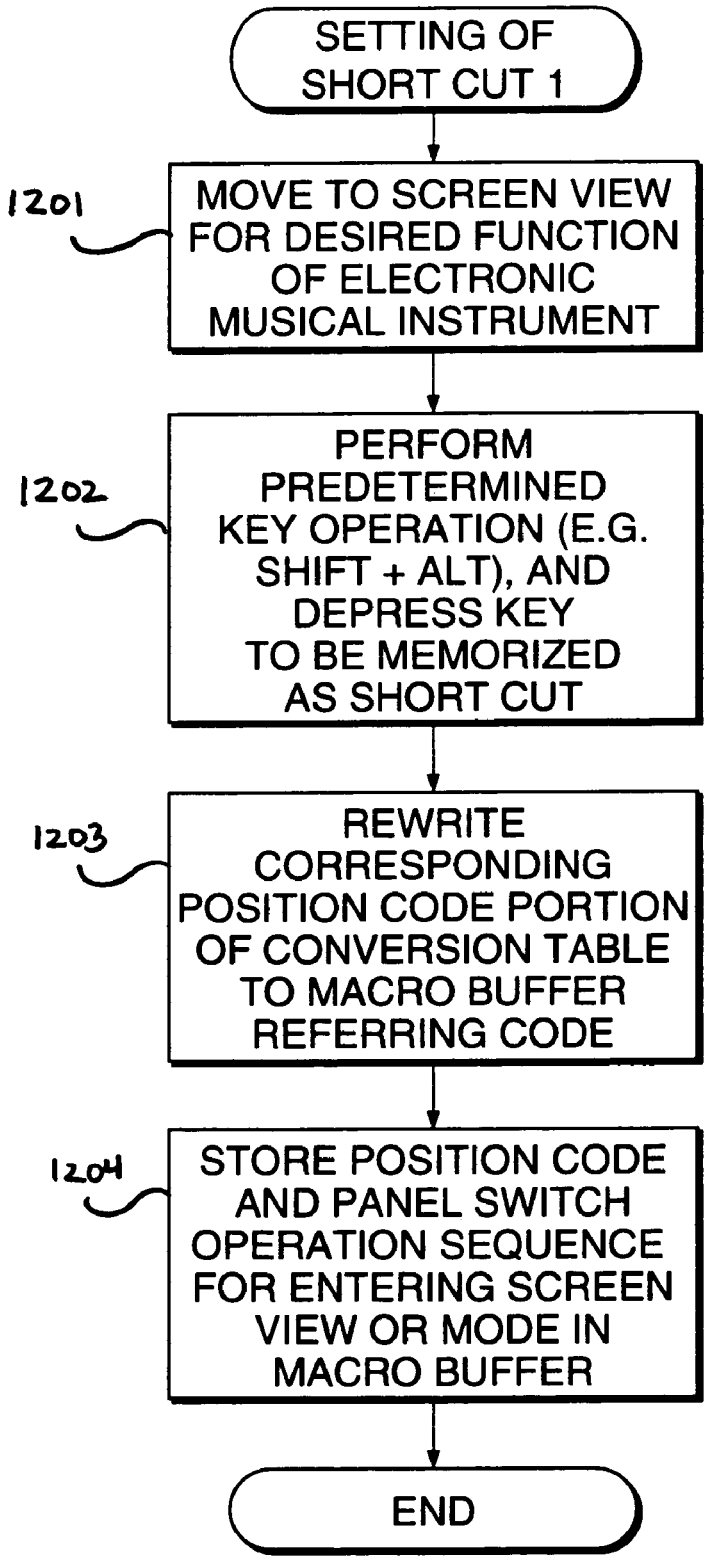
FIG. 12 is a flow chart showing a flow of a procedure for setting a short-cut.

FIG. 12 is a flow chart showing an example of a procedure for setting a short-cut. In step 1201, a plurality of operations are performed to call a screen view of a desired function of the electronic musical instrument. In step 1202, a predetermined key operation (for example, depression of SHIFT key+ALT key) is performed on the called screen view, followed by depression of the key to be memorized as a short-cut. Next, in step 1203, a portion of the corresponding position code (the position code of the key to be memorized as a short-cut) in the conversion table of FIG. 15A is rewritten into a code for referring to a macro buffer (for example, "FF" shown in FIG. 15A). Then, in step 1204, the position code and an operation sequence of panel switches for calling the screen view or the mode are stored in the macro buffer, followed by terminating the operation.

Figure 15C:
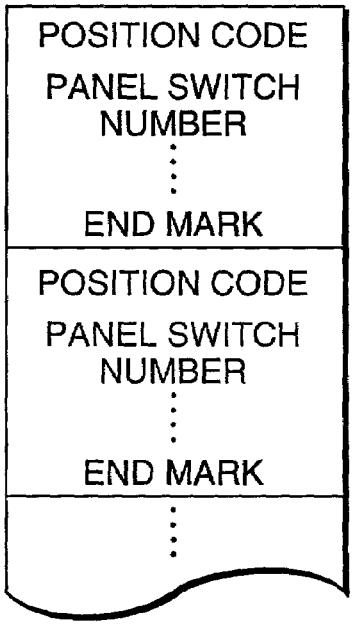

The macro buffer stores an operation sequence consisting of a plurality of operations sequentially executed when the key that is set as a short-cut is turned on. FIG. 15C shows an example of the macro buffer. The macro buffer stores a series of data consisting of position codes of keys that are set as short-cuts, operation sequences (sequences of panel switch numbers) to be performed respectively when the keys are turned on, and end marks that each indicate the end of the operation sequence.

Figure 13:
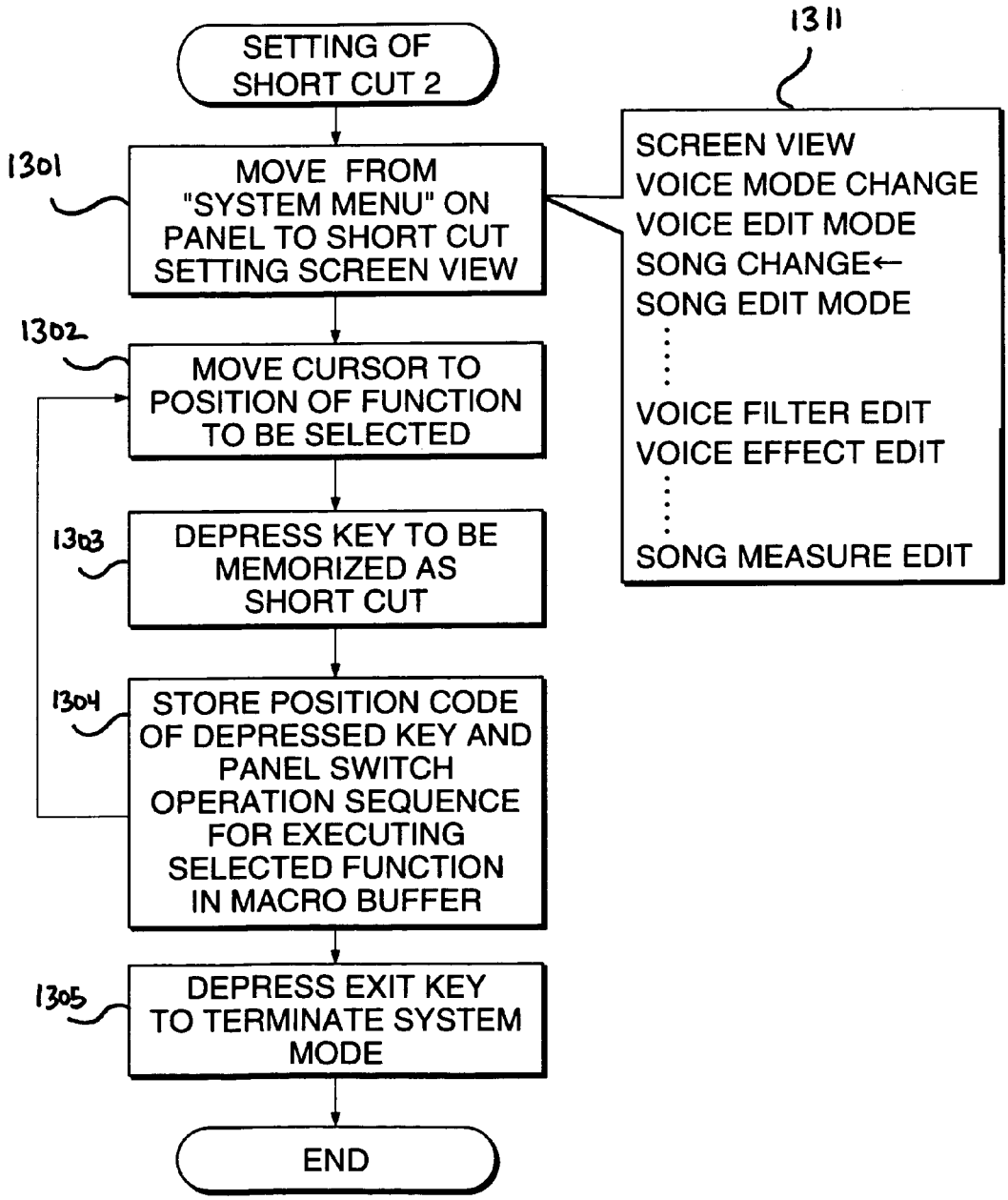
FIG. 13 is a flow chart showing a flow of another procedure for setting a short-cut.

FIG. 13 is a flow chart showing another example of the procedure for setting a short-cut. In step 1301, the operation moves from the system menu to the screen view for setting a short-cut. Screen view 1311 is an example of the displayed screen view for setting a short-cut, and is in the form of a list of functions of the electronic musical instrument. In step 1302, the cursor is moved to the position of a function to be selected in the list of functions in the screen view 1311. Next, in step 1303, the key of the PC keyboard to be memorized as a short-cut is depressed. In step 1304, the position code of the depressed key and the operation sequence of panel switches that executes the selected function to which the cursor is set are stored in the macro buffer of FIG. 15C. The steps 1302 to 1304 are repeated as required to store short-cuts. In step 1305, the exit key is turned on to go through the system mode and terminate the operation.

Figure 14:
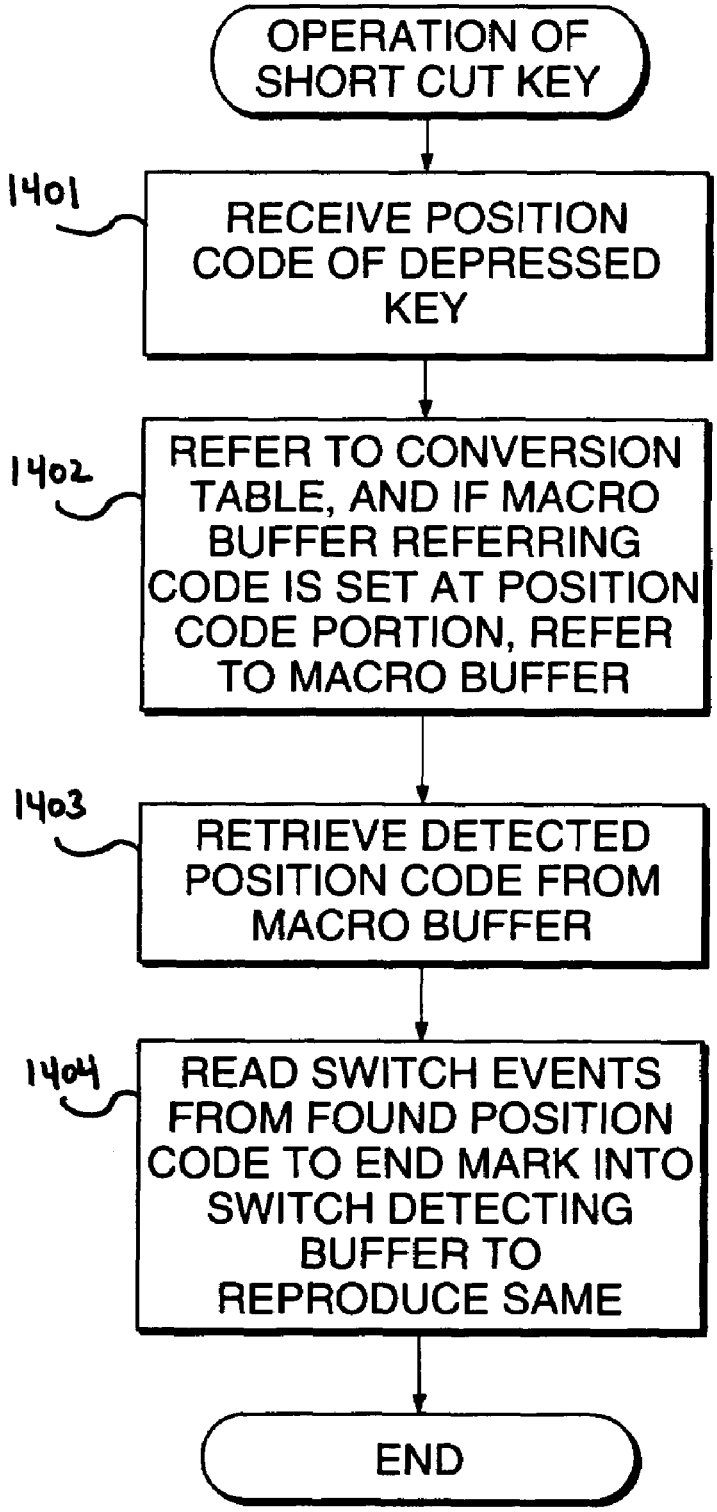
FIG. 14 is a flow chart showing a flow of a processing operation executed when a short-cut key is operated.

FIG. 14 is a flow chart showing a flow of a processing operation executed when a short-cut key is operated. In step 1401, the position code of the depressed key of the PC keyboard is received. In step 1402, by referring to the conversion table of FIG. 15A, it is determined whether the macro buffer referring code FF is set at the position of the position code or not. If it is determined in the affirmative, the macro buffer of FIG. 15C is referred to. If the macro buffer referring code FF is not set at the position, by referring to the conversion table and the module table, the ordinary processing operation as explained with reference to FIG. 8 or FIG. 11 is performed. If the macro buffer referring code FF is set at the position, in step 1403, the above-mentioned detected position code is retrieved from the macro buffer. In step 1404, switch events (panel switch numbers) from the retrieved position code to the position of the end mark are read out into a switch detection buffer to reproduce the same. Thus, the operations of the panel switch numbers registered in the macro buffer are successively stored in a buffer of a switch scan unit, as if the operations are successively performed.

In the above described manner, a series of operation sequences can be carried out by simply depressing the short-cut keys.

In the present invention, the term "electronic musical instrument" shall include so-called "tone generator box" (tone generating module), rhythm box (rhythm machine), sequencer, data filer (that performs file management of tone color data and performance data), and "MIDI karaoke machine" which has no keyboard, and "master keyboard" which consists solely of a keyboard.

As described above, according to the present invention, a keyboard as used in personal computers can be connected to the electronic musical instrument, and various settings for the electronic musical instrument can be made by the PC keyboard instead of operations on the panel. In recent years, the standard for the PC keyboard has been unified to some extent, leading to wide use of PC keyboards at low prices. Thus, it is now possible with such widely used PC keyboards to simplify and easily input the complicated setting operations of the electronic musical instrument. Further, according to the present invention, when a key is depressed on the PC keyboard, the waiting state for input is first determined, and if the depressed key is significant, the key depression is processed in the present state as it is. On the other hand, if the depressed key is of no significance, the function that is assigned to the depressed key is started and executed, which is greatly convenient for the user. In addition, a sequence of a plurality of operations can be assigned to one key on the PC keyboard so that the sequence of a plurality of operations may be carried out simply by depressing the key, to substantially simplify the complicated operation.

What is claimed is:

1. An electronic musical instrument comprising:

an operation panel that is operated by a user;

at least one connection terminal connectable with a keyboard originally designed for use in a computer, said keyboard having a plurality of key regions each including a plurality of keys;

a first connection interface for use as a MIDI interface;

a second connection interface for connecting said keyboard directly to said electronic musical instrument;

a first assigning device that assigns function modules respectively to the key regions of said keyboard connected via said connection terminal and said second connection interface;

a second assignment device that assigns characters, symbols, or numerical values respectively to the keys of said keyboard connected to said electronic musical instrument; and an execution device that is responsive to operation of any of the key regions of said keyboard, for executing a function corresponding to one of the function modules assigned to the operated key region;

wherein said execution device causes an operated key to input a character, a symbol, or a numerical value assigned to the operated key, and wherein when one of the function modules is assigned to the operated key region, said execution device causes the input character, the input symbol or the input numerical value to be delivered to the function module assigned to the operated key region.

2. An electronic musical instrument as claimed in claim 1, further comprising a third assignment device that specifies key arrangements of said keyboard connected to said electronic musical instrument by selecting a template, and wherein the key arrangements of said keyboard are specified by using at least one of said second assignment device and said third assignment device.

3. An electronic musical instrument as claimed in claim 1, wherein said connection terminal is provided on a front face of said electronic musical instrument.

* * * * *